US005685490A

United States Patent [19]

Ausman et al.

[11] Patent Number: 5,685,490

[45] Date of Patent: Nov. 11, 1997

[54] FUEL INJECTOR WITH PRESSURE BLEED-OFF STOP

[75] Inventors: Thomas G. Ausman, Metamora; Timothy E. Delaney, Peoria, both of Ill.; Jeffrey C. Huang, Greenwood, Ind.; Charles R. Riggert, Metamora, Ill.; Michael T. Zimmer, Brookfield, Wis.

[73] Assignee: Caterpillar Inc., Peoria, Ill.

[21] Appl. No.: 589,518

[22] Filed: Jan. 22, 1996

Related U.S. Application Data

[63] Continuation of Ser. No. 507,954, Jul. 27, 1995, abandoned.

[51] Int. Cl.[6] ..... F02M 61/20

[52] U.S. Cl. ..... 239/533.9

[58] Field of Search ..... 239/88, 89, 533.3, 239/533.5, 533.9

[56] References Cited

U.S. PATENT DOCUMENTS

| | | | |
|---|---|---|---|
| 3,126,158 | 3/1964 | Dreisin | 239/533 |
| 3,175,771 | 3/1965 | Breting | 239/533 |
| 3,403,861 | 10/1968 | Eidtmann et al. | 239/533 |
| 4,684,067 | 8/1987 | Cotter et al. | 239/533.3 |
| 4,911,127 | 3/1990 | Perr | 123/446 |
| 4,934,599 | 6/1990 | Hasagawa | 239/533.9 X |
| 4,946,103 | 8/1990 | Ganser | 239/88 |
| 4,962,890 | 10/1990 | Shindo et al. | 239/533.4 |
| 5,094,397 | 3/1992 | Peters et al. | 239/89 X |
| 5,127,583 | 7/1992 | Taue | 239/96 |
| 5,143,291 | 9/1992 | Grinsteiner | 239/88 |
| 5,423,484 | 6/1995 | Zuo | 239/90 |
| 5,487,508 | 1/1996 | Zuo | 239/533.9 X |

FOREIGN PATENT DOCUMENTS

| | | |
|---|---|---|
| 3204961 | 9/1983 | Germany . |
| 3801929 | 8/1988 | Germany . |
| 4118236 | 12/1991 | Germany . |

*Primary Examiner*—Lesley D. Morris
*Attorney, Agent, or Firm*—Liell & McNeil

[57] ABSTRACT

A fuel injector with a hydraulically actuated needle check includes a fuel pressurization chamber positioned between a low pressure fuel supply passage and a nozzle supply bore. A portion of the low pressure fuel supply passage is in direct fluid communication with the fuel pressurization chamber via a bleed hole. A bleed pin extends into a fluid supply chamber adjacent the bleed hole. The bleed pin is movable between a first position in which the bleed hole is open and a second position in which a portion of the bleed pin closes the bleed hole when the hydraulically actuated needle check moves between its closed position and its open position, respectively. A supply valve is positioned in the low pressure fuel supply passage between the low pressure fuel supply chamber and the fuel pressurization chamber in order to prevent the back flow of fuel from the pressurization chamber into the supply passageways. When in operation, the movement of the needle check serves to open and close the bleed hole at precise times in order to both produce pilot type rate shaping at the beginning of each injection event and cause the abrupt termination of fuel flow out of the nozzle at the end of each injection event.

11 Claims, 5 Drawing Sheets

FUEL INJECTOR WITH PRESSURE BLEED-OFF STOP

This is a continuation of application Ser. No. 08/507,954, filed Jul. 27, 1995 and now abandoned.

TECHNICAL FIELD

The present invention relates generally to fuel injectors, and more particularly to fuel injectors with a hydraulically actuated needle check valve.

BACKGROUND ART

It has long been known that combustion efficiency and exhaust emissions can be improved by causing each injection event to end as abruptly as possible. In fuel injectors having a hydraulically actuated needle check, an abrupt end to each injection event can usually only be accomplished by somehow relieving hydraulic fuel pressure acting on the needle check at the desired end of injection. While it is known that relieving pressure on the needle check can desirably provide an abrupt end to injection, in the past engineers have experienced great difficulty in accomplishing such pressure relief without undermining other performance characteristics of the injector and/or significantly increasing complexity and unreliability of the injector. For instance, one such undesirable method might be to include a solenoid activated pressure relief valve that is activated to relieve pressure on the needle check when it is desired to end the injection event.

In a typical injector having a hydraulically actuated needle check, the needle check is bias closed by a spring but opens when fuel pressure acting on the hydraulic surface of the needle check reaches a threshold pressure which is sufficient to overcome the force of the check return spring. Toward the end of each injection event, hydraulic fuel pressure acting on the check drops below that necessary to overcome the return spring, and the needle check begins to move toward its closed position. However, fuel with a steadily lowering pressure continues to exit the injector nozzle as the needle check moves toward its closed position. It is believed that this relatively low pressure flow of fuel into the engine decreases combustion efficiency and increases undesirable emissions by allowing unburned hydrocarbons into the exhaust from the engine.

One method of reducing this undesirable low pressure fuel flow into the engine toward the end of each injection event would be to hasten the speed at which the needle check moves from its open position to its closed position, such as by providing a return spring with a higher force constant. Unfortunately, the use of a stronger return spring alters the valve opening pressure of the needle check, and therefore alters the performance characteristics of the injector. Another method of abruptly ending injection might be to find a way to relieve the residual pressure acting on the needle check. By doing so, the needle check necessarily closes quicker because residual hydraulic forces acting on the needle check are lessened and the residual flow of fuel out of the nozzle is also reduced in direct proportion to the lowering of the residual fuel pressure. Engineers have long struggled with a way of incorporating these concepts into an injector without significantly increasing the complexity of the injector and/or undesirably altering other performance characteristics of the injector, such as valve opening pressure.

In addition to the desirability of an abrupt end to injection is the fact that it has been long known that combustion efficiency and exhaust emissions can be improved by rate shaping the fuel injection mass flow rate. Typically, it has been found that combustion efficiency and engine performance are improved when injection mass flow rate is low toward the beginning of each injection event (oftentimes referred to as pre-injection or pilot injection), but injection mass flow increases over the latter portion of the injection event to provide what is often referred to as main injection. While the prior art shows a myriad of different ways in which fuel injectors have been controlled to provide rate shaping, most of these methods are difficult to incorporate into existing injector designs and/or are not justified due to the increased complexity and unreliability that some rate shaping techniques bring to the fuel injector.

The present invention is directed to overcoming the one or more of the problems as set forth above.

DISCLOSURE OF THE INVENTION

A fuel injector according to the present invention includes a fuel pressurization chamber positioned between a low pressure fuel supply passage and a nozzle supply bore. The injector also includes a nozzle in fluid communication with the nozzle supply bore. A portion of the low pressure fuel supply passage can be characterized as a low pressure fuel supply chamber that is in direct fluid communication with the fuel pressurization chamber via a bleed hole. The injector also includes a hydraulically actuated needle check with one end positioned in the nozzle supply bore and is moveable between a closed position that closes the nozzle and an open position that opens the nozzle. As is typical, the injector includes some means, within the injector body, such as a spring, for biasing the needle check toward its closed position. A bleed pin extends into the fuel supply chamber adjacent the bleed hole. The bleed pin is moveable between a first position in which the bleed hole is opened and a second position in which a portion of the bleed pin closes the bleed hole. A supply valve, such as a check valve, is positioned in the low pressure fuel supply passage between the low pressure fuel supply chamber and the fuel pressurization chamber. The supply valve prevents flow of fuel from the fuel pressurization chamber toward the low pressure fuel supply chamber through the low pressure fuel supply passage. The injector also includes means, within the injector body, from moving the bleed pin from its second position toward its first position to open the bleed hole when the needle check moves from its open position toward its closed position. Finally, the needle check moves from its closed position toward its open position when fuel pressure within the nozzle supply bore is above a threshold valve opening pressure.

When in operation, a fuel injector according to the present invention is configured to allow movement of the needle check itself to relieve the residual hydraulic fuel pressure acting on the needle check. In other words, toward the end of each injection event, when the needle check begins to move from its open position toward its closed position, residual fuel pressure is quickly relieved through the bleed hole. The present invention also has the advantage on the front side of each injection event of rate shaping the mass flow rate of the fuel being injected by allowing a portion of the pressurized fuel to escape through the bleed hole before the same is closed by movement of the needle check.

One object of the present invention is to provide an abrupt end to injection mass flow.

Another object of the present invention is to rate shape fuel injection in a way that improves combustion efficiency and reduces undesirable emissions.

Still another object of the invention is to control fuel injection mass flow in the way described above without significantly increasing the manufacturing or operational complexity of the fuel injector.

Another object of the present invention is to provide improved fuel injectors having hydraulically actuated needle check valves.

BEST MODE FOR CARRYING OUT THE INVENTION

Figure 1:
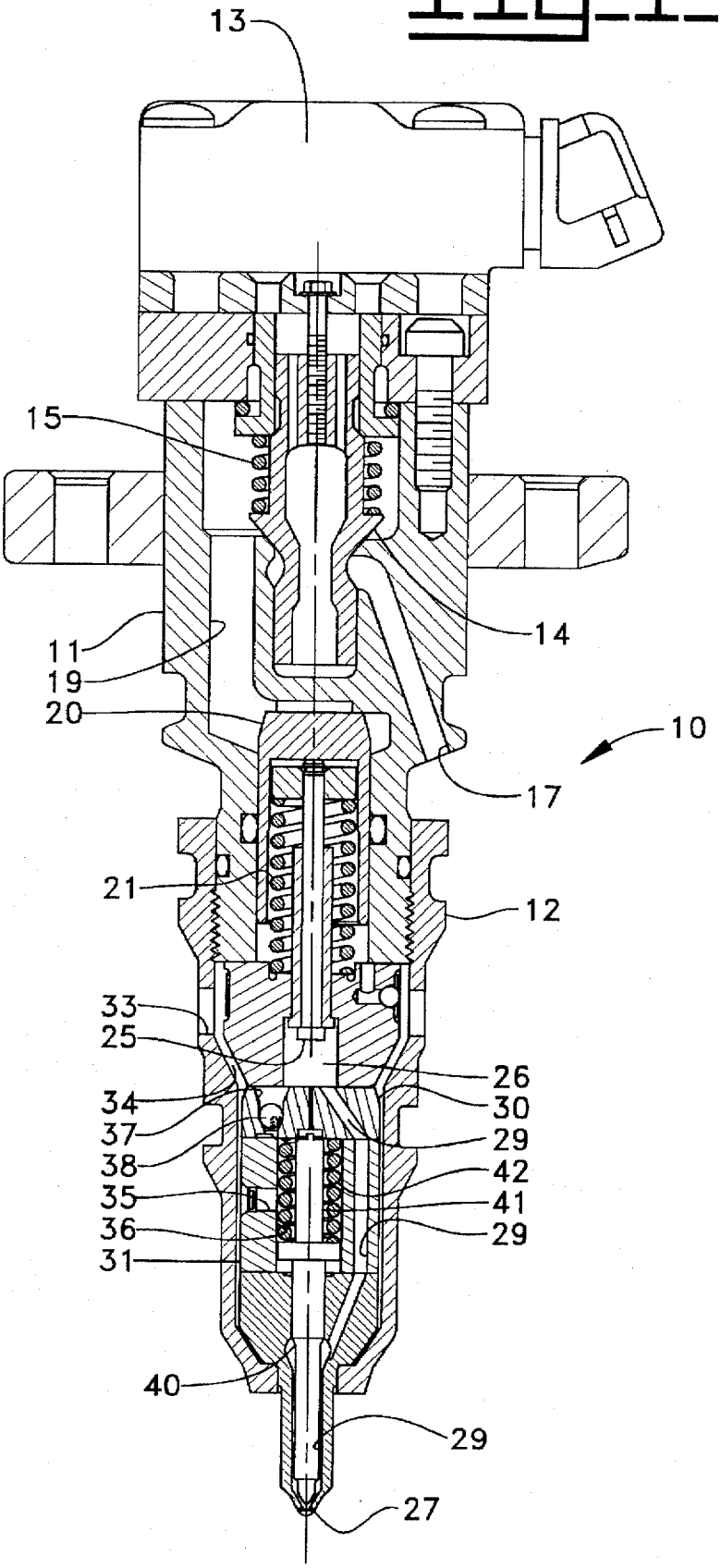
FIG. 1 is a sectioned side elevational view of a fuel injector according to the preferred embodiment of the present invention.

Referring now to FIG. 1, a hydraulically actuated electronically controlled fuel injector 10 according to the preferred embodiment of the present invention is illustrated. Fuel injector 10 is a Caterpillar, Inc. fuel injector of the type described in detail in U.S. Pat. No. 5,121,730 to Ausman et al., which description is incorporated herein by reference. Nevertheless, a brief review of the various components of injector 10 will be useful in aiding those skilled in the art in understanding the operation of the present invention. However, it should be pointed out that although the invention is illustrated in relation to a hydraulically actuated electronically controlled fuel injector, those skilled in the art will immediately appreciate that the principles of the present invention can be applied and incorporated into virtually any fuel injector having a hydraulically actuated needle check. For instance, the present invention could be incorporated into fuel injectors utilizing a cam driven mechanical action to pressurize the fuel as opposed to the pressurization of the fuel by a hydraulic means as in the illustrated injector 10.

Fuel injector 10 includes an upper injector body 11 and a lower injector body 12 that together enclose the majority of passageways and components within the injector. Each injection event is initiated by activating solenoid 13 such that control valve 14 moves off its seat against the action of compression spring 15. This allows the flow of high pressure hydraulic fluid through inlet 17 and into actuation fluid supply bore 19. Injector 10 preferably utilizes high pressure oil as its hydraulic actuation fluid. As pressure within actuation fluid supply bore 19 rises, piston 20 begins its downward movement against the action of piston return spring 21. When control valve 14 is seated, the hydraulic actuation fluid within supply bore 19 returns to a lower pressure, such as atmospheric pressure, by means of an actuation fluid drain as more thoroughly described in the Ausman et al. patent.

When piston 20 begins its downward movement, a plunger 25 is driven downward pressurizing the fuel within fuel pressurization chamber 26. As plunger 25 continues its downward movement, fuel pressure within fuel pressurization chamber 26 begins to rise, which simultaneously raises the fuel pressure within nozzle supply bore 29. When the fuel pressure within nozzle supply bore 29 reaches a threshold valve opening pressure (see FIG. 4, $P_{INJ}$), the upward hydraulic forces acting on needle check 40 cause it to lift against the action of its check return spring 42. As can be seen, a portion of needle check 40 extends into nozzle supply bore 29 and acts to close nozzle 27 to nozzle supply bore 29 when in its closed position but allows fuel flow through injector nozzle 27 when needle check 40 is lifted to its open position by the hydraulic forces produced by the pressurized fuel.

Each injection event is ended by deactivating solenoid 13, which causes control valve 14 to close under the action of its compression spring 15 to terminate the flow of high pressure hydraulic fluid through inlet 17. This in turn ceases the downward movement of piston 20 and plunger 25, thus causing the fuel pressure within fuel pressurization chamber 26 to fall until the fuel pressure is no longer sufficient to overcome the biasing force produced by check return spring 42. Thus, the needle check 40 begins moving downward from its open position to its closed position where it eventually reaches its seat to close nozzle 27, ending the injection event.

In between injection events, piston 20 and plunger 25 move upward under the action of piston return spring 21. This upward movement of plunger 25 causes low pressure fuel to be drawn into fuel pressurization chamber 26 through fuel supply passage 37. A low pressure fuel inlet 33 communicates with fuel supply passage 37 via fuel supply passage 34, fuel supply passage 35 and fuel supply chamber 36. Check valve 38 prevents the reverse flow of fuel into the supply passages during an injection event.

In order to sustain injection, plunger 25 must continue its downward movement at a rate sufficient to maintain the fuel in fuel pressurization chamber 26 above a threshold valve opening pressure, which depends upon the strength of check return spring 42. In prior art fuel injectors, the position of plunger 25, its rate of movement, and its direction of movement control the fuel pressure within fuel pressurization chamber 26. In prior art fuel injectors of this type, residual fuel pressure at the end of each injection event is relieved by the upward movement of plunger 25 and the escape of lower pressure fuel out of nozzle 27 as needle check 40 moves to its closed position. The present invention is directed primarily to a way of relieving pressure in the fuel pressurization chamber 26 toward the end of injection in a way that is independent of the movement of plunger 25 and substantially ends injection without relying upon the complete closure of needle check 40. The present invention seeks to exploit the movement of needle check 40 itself in order to provide the means by which residual fuel pressure is relieved at the end of each injection event in order to provide an abrupt end to the injection.

Figure 2:
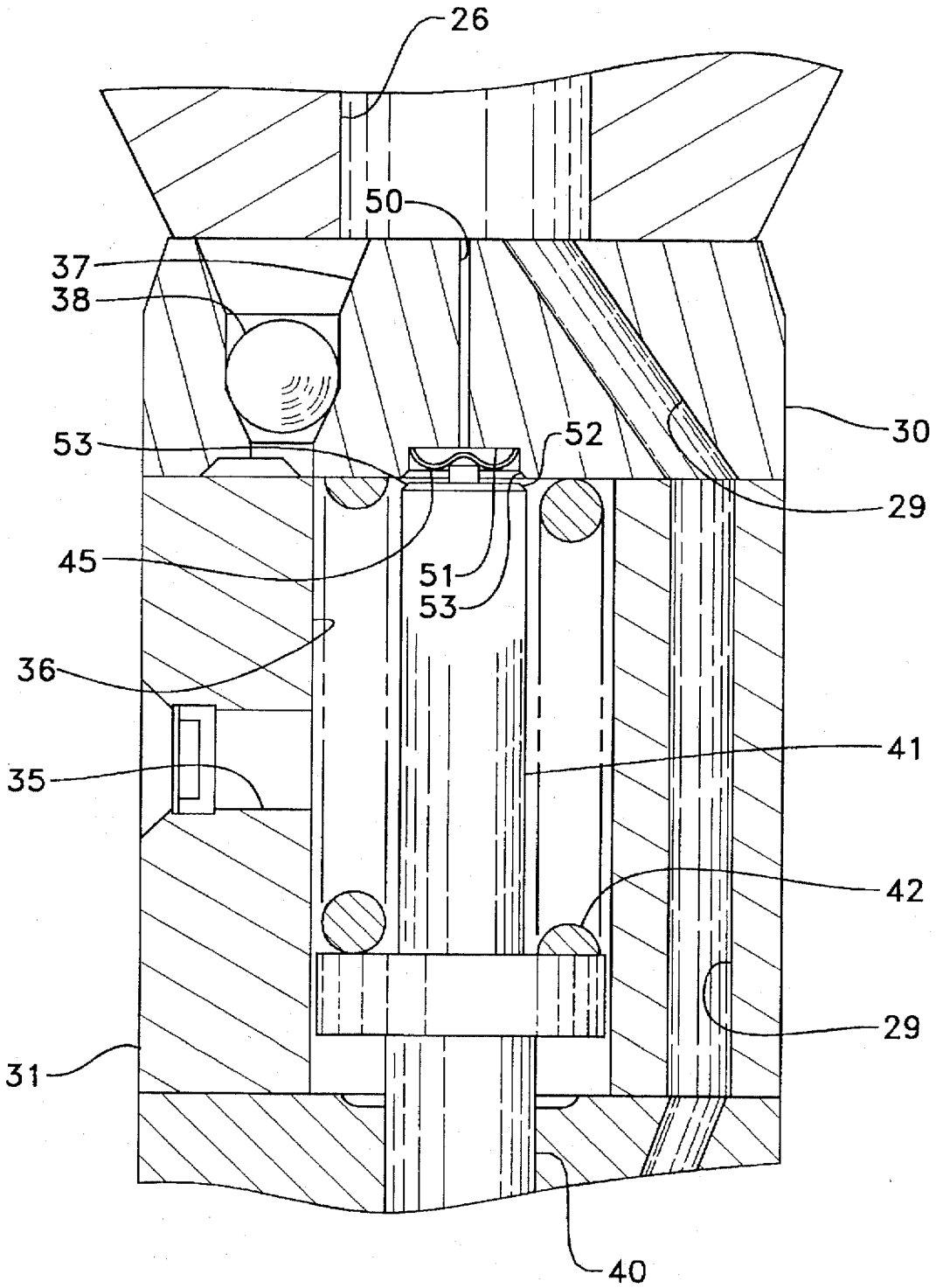
FIG. 2 is an enlarged partial sectioned side elevational view of a portion of the fuel injector shown in FIG. 1.

Referring now to FIG. 2, an enlarged view of a portion of the injector shown in FIG. 1 shows the relevant features of the present invention. Injector 10 of the present invention differs from prior art injectors of the same type by the inclusion of a bleed hole 50 in stop 30. The present invention also differs in that bleed pin 41 is machined to include a beveled valve surface 53 that seats against beveled bleed valve seat 52 that is included as a portion of counter-bore chamber 51 machined in the underside of stop 30. Bleed pin 41 is preferably cylindrical in shape and is positioned directly above and collinear with needle check 40. Thus bleed pin 41 simultaneously acts as a stop for needle check 40 and as a valve for bleed hole 50. The present invention also differs from prior art fuel injectors of the present type by the inclusion of a wave spring 45.

Figure 3:
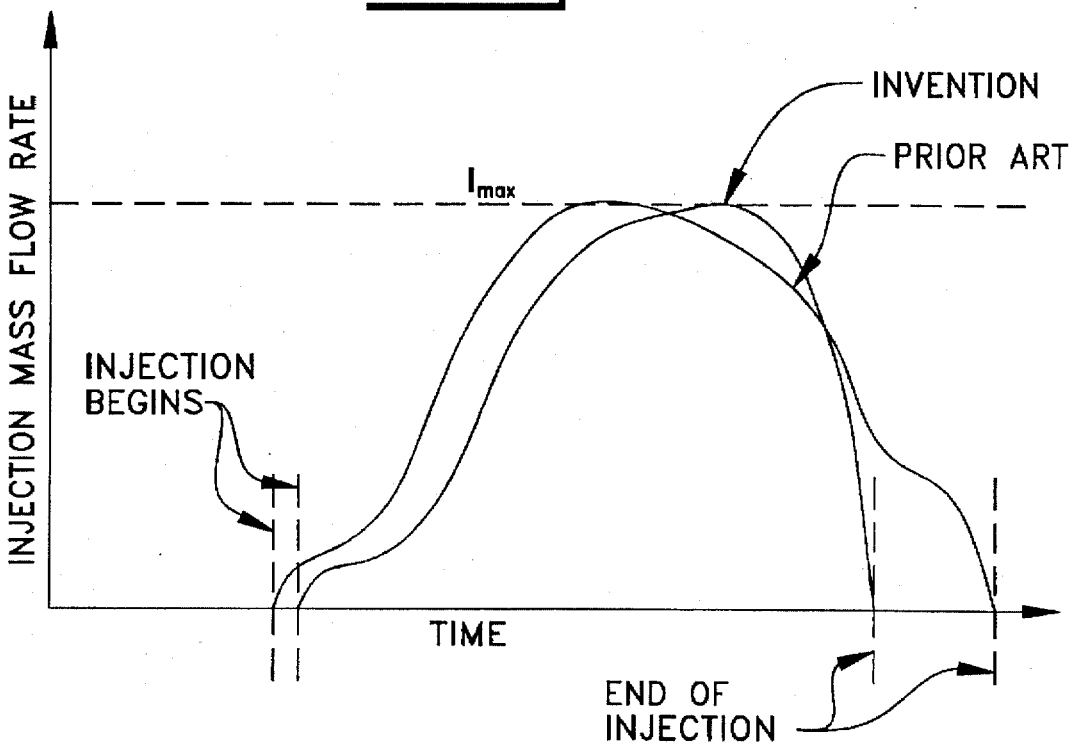
FIG. 3 is a graph of injection mass flow rate versus time for a prior art fuel injector and a counter-part fuel injector according to the present invention.
Figure 4:
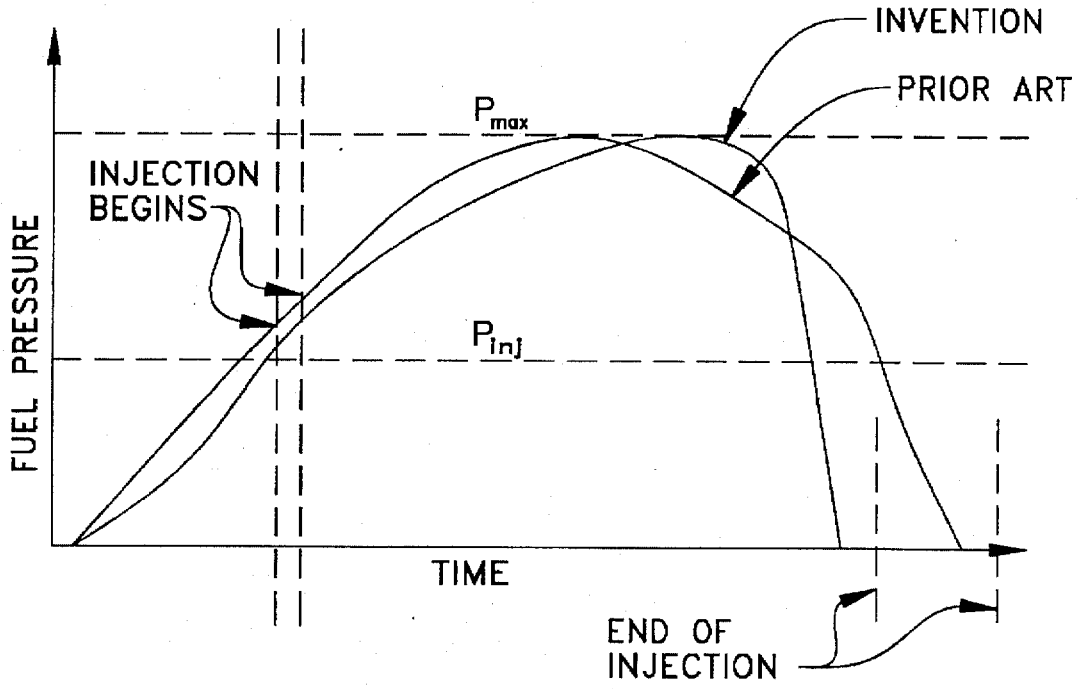
FIG. 4 is a graph of fuel pressure versus time for the fuel injectors graphed in FIG. 3.

Referring simultaneously to FIGS. 2, 3 and 4, the differing performance of the present injector over prior art injectors will be illustrated. At the initiation of each injection event, fuel pressure within fuel pressurization chamber 26 begins to rise. At this time, needle check 40 is in its closed position because the fuel pressure has not risen sufficiently to overcome the bias of check return spring 42. Thus at this point pressure is rising in nozzle supply bore 29 but the flow of fuel to the nozzle has not yet begun. While check valve 38 prevents the back flow of pressurized fuel through supply passage 37, a portion of the fuel in fuel pressurization chamber 26 bleeds through bleed hole 50 into low pressure fuel supply chamber 36. Bleed hole 50 preferably has a cross-sectional area on the order of a fraction of the total cross-sectional flow area through nozzle 27 (see FIG. 1). Because bleed hole 50 is of such a small diameter, pressure within fuel pressurization chamber 26 continues to rise despite the loss of a portion of the fuel through bleed hole 50. Eventually, the fuel within fuel pressurization chamber 26 and nozzle supply bore 29 reaches a threshold amount ($P_{INJ}$, FIG. 4) that is sufficient to lift needle check off its seat and begin the injection of fuel into the combustion chamber of the engine.

The mass flow out of the injector continues to rise as the needle check moves farther from its seat to provide a larger flow clearance area, and the rising fuel pressure itself causes an increase in fuel mass flow. However, in the present invention, this injection flow rate is lower than it would otherwise be in a prior art injector because a portion of the fuel that would otherwise be injected out of the nozzle is instead pushed out of fuel pressurization chamber 26 back into row pressure fuel supply chamber 36 through bleed hole 50. This lower fuel mass flow rate at the beginning of injection is desirable because it produces a sort of pilot injection. At this point the needle check 40 is moving upward between its closed position and its open position. A short time later, needle check 40 is stopped in its upward movement at its opened position when the beveled valve surface 53 of bleed pin 41 seats against beveled bleed valve seat 52. At this same time, wave spring 45 is being compressed. It is important to note that wave spring 45 is uncompressed when needle check 40 is in its downward most closed position. Otherwise, wave spring 45 would change the valve opening pressure of needle check 40.

Recalling, at this point, needle check has moved to its open position, bleed pin 41 has closed bleed hole 50 and fuel continues to flow from the injector nozzle. Because bleed valve 50 is now closed and because fuel pressure continues to rise, injection mass flow rapidly ramps upward until reaching a maximum value which corresponds to when the fuel pressure reaches its maximum pressure ($P_{MAX}$, FIG. 4). Shortly before the desired amount of fuel has been injected, solenoid 13 (FIG. 1) is deactivated and further pressurization of fuel within fuel pressurization chamber 26 ceases. At this point, fuel pressure has begun to drop, but bleed hole 50 is closed, and fuel continues to flow through nozzle supply bore 29 and out of the nozzle of the injector. Eventually the fuel pressure drops low enough that the combined force of check return spring 42, wave spring 45 and the downward hydraulic force acting on the top side of bleed pin 41 are sufficient to overcome the upward hydraulic force produced by the residual fuel pressure acting on needle check 40. This allows beveled valve surface 53 to lift off of beveled valve seat 52 to allow the residual fuel pressure in fuel pressurization chamber 26 and nozzle supply bore 29 to quickly evacuate through bleed hole 50 into low pressure fuel supply chamber 36. This abrupt lowering of the fuel pressure serves to bring the injection of fuel to an abrupt end in two ways: (1) the lowering of fuel pressure necessarily lowers the residual fuel injection rate, and (2) the lowered fuel pressure allows the needle check return spring 42 to hasten the movement of needle check 40 to its closed position. FIGS. 3 and 4 show how the present invention both improves performance by rate shaping at the front side of the injection event and by creating an abrupt end to the injection event at the end side of injection.

Figure 5:
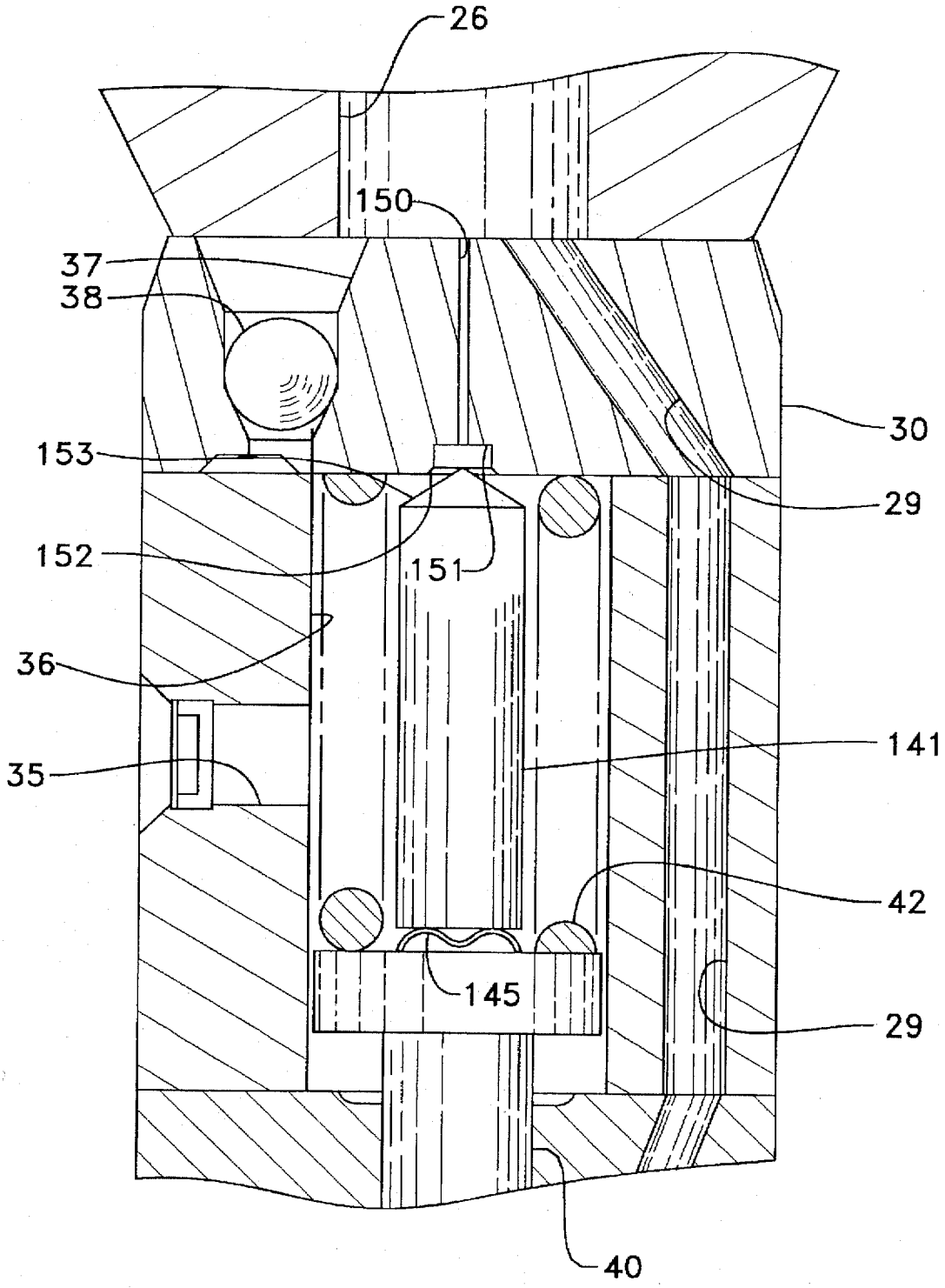
FIG. 5 is an enlarged partial sectioned side elevational view of a portion of a fuel injector according to another embodiment of the present invention.

Referring now to FIG. 5, a second embodiment of the present invention is illustrated that is similar to the earlier embodiment except that bleed pin 141 is not attached to or resting directly against a portion of needle check 40, as in the previous embodiment. Instead, a wave spring 145 is positioned between the spring support surface of needle check 40 and the bottom side of bleed pin 141. Like the earlier embodiment, fuel supply chamber 36 communicates with bleed hole 150 via counter-bore chamber 151. Likewise, counter-bore chamber 151 includes a beveled valve seat portion 152 against which beveled valve surface 153 of bleed pin 141 seats when bleed pin 141 is pushed against stop 30 by the upward movement of needle check 40. This embodiment performs substantially similar to the earlier embodiment except that the upward movement of needle check 40 is delayed briefly by the compression of wave spring 145 when needle check 40 is moving upward toward its open position. This serves to slightly prolong the pilot injection portion of each injection event because restricting the needle check lift distance restricts injection mass flow out of the nozzle. Like the earlier embodiment, the drop in fuel pressure at the end of the injection event opens bleed hole 150 to relieve the residual fuel pressure and provide an abrupt end to injection. It is important to note that, like the earlier embodiment, the additional wave spring does not change the valve opening pressure of the needle check 40.

Figure 6:
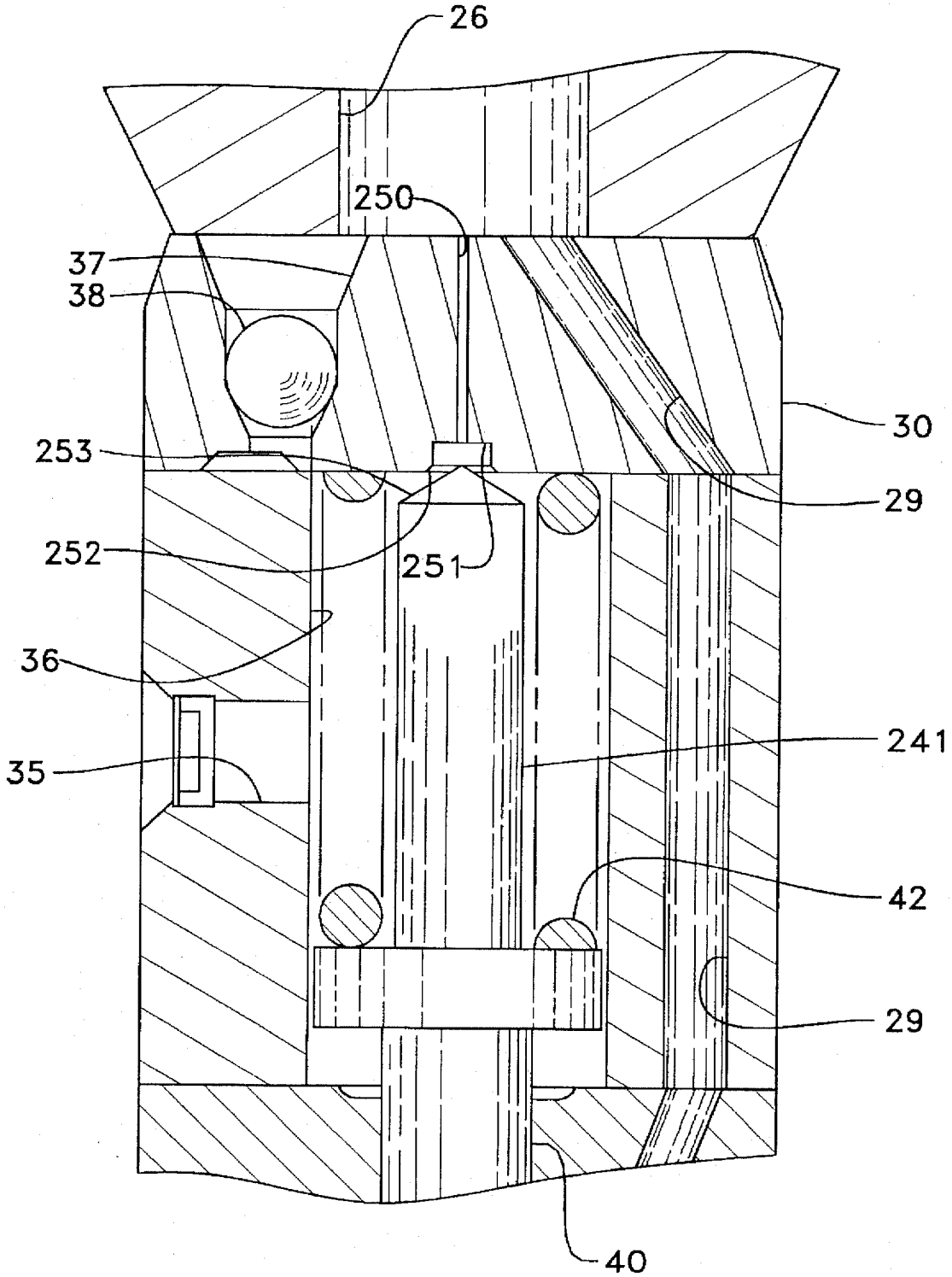
FIG. 6 is an enlarged partial side sectioned elevational view of a portion of a fuel injector according to still another embodiment of the present invention.

FIG. 6 shows still another embodiment of the present invention which is similar to the first embodiment in the sense that bleed pin 241 is either attached to or resting directly against the spring support surface portion of needle check 40, but no additional spring is included in this embodiment. As in the earlier embodiments, the upward movement of needle check 40 causes beveled valve surface 253 of bleed pin 241 to seat against beveled valve seat 252 made as part of counter-bore chamber 251, which communicates directly with bleed hole 250. Like the earlier embodiments, the open bleed hole 250 at the beginning of the injection event lowers the injection mass flow rate, the closure of bleed hole 250 during the injection event allows for high main injection rates, and the reopening of bleed hole 250 toward the end of the injection event helps to promote an abrupt end to the injection of fuel from the injector.

Industrial Applicability

Although the present invention has been illustrated in relation to a hydraulically actuated electronically controlled fuel injector, the present invention finds potential applicability in a wide variety of fuel injectors having a hydraulically actuated needle check valve. In most cases, the concepts of the present invention can be incorporated into prior art injectors without any significant changes to the existing structure, by simply machining the necessary bleed hole and valve and seating surfaces. In some injectors it may be easier to modify the bleed hole location and the shape of bleed pin 241 to serve as a spool valve rather than the type of valve illustrated in FIGS. 2, 5 and 6. Those skilled in the art will immediately appreciate other modifications that fall within the contemplated scope of the present invention. For instance, other types of springs could be substituted for the wave springs shown in the embodiments of FIGS. 2 and 5. Additionally, one can envision still another embodiment having springs on the top and bottom sides of the bleed pin. In such a way, the pilot portion of an injection event could be prolonged and the opening of bleed hole 250 toward the end of injection is hastened to relieve the residual fuel pressure. Such an embodiment would combine the structure of the embodiments shown in FIGS. 2 and 5. However, in many cases the simple embodiment of FIG. 6 will be sufficient to produce the desired injection characteristics.

It should be understood that the above description is intended only to illustrate the concepts of the present invention, and is not intended to in any way limit the potential scope of the present invention. For instance, those skilled in the art will immediately recognize the applicability of the concepts of the present invention to other fuel injectors having a hydraulically actuated check valve. In any event, the scope of the invention is defined solely by the claims as set forth below.

We claim:

1. A fuel injector comprising:

an injector body with a nozzle supply bore extending between a nozzle outlet and a fuel pressurization chamber, and a bleed hole extending between a low pressure passage and said fuel pressurization chamber;

a needle check with one end positioned in said nozzle supply bore and being movable between a closed position in which said nozzle outlet is closed and an open position in which said nozzle outlet is open;

a bleed pin positioned in said injector body and being movable between a first position in which said bleed hole is open and a second position in which a portion of said bleed pin closes said bleed hole; and a spring positioned in said injector body that is compressed and in contact with one end of said bleed pin when said bleed pin is in said second position, and said spring being substantially uncompressed when said bleed pin is in said first position.

2. The fuel injector of claim 1 wherein said spring is positioned between said needle check and said bleed pin.

3. The fuel injector of claim 1 wherein said spring is positioned between said fuel pressurization chamber and said bleed pin.

4. A fuel injector comprising:

an injector body with a nozzle supply bore extending between a nozzle outlet and a fuel pressurization chamber, and a bleed hole extending between a low pressure passage and said fuel pressurization chamber;

a needle check with one end positioned in said nozzle supply bore and being movable between a closed position in which said nozzle outlet is closed and an open position in which said nozzle outlet is open;

a bleed pin positioned in said injector body and being movable between a first position in which said bleed hole is open and a second position in which a portion of said bleed pin closes said bleed hole; and a spring positioned in said injector body that is compressed when said bleed pin is in said second position, but said spring being substantially uncompressed when said needle check is in said closed position.

5. The fuel injector of claim 4 wherein said spring is positioned between said needle check and said bleed pin.

6. The fuel injector of claim 4 wherein said spring is positioned between said fuel pressurization chamber and said bleed pin.

7. A fuel injector comprising:

an injector body with a fuel pressurization chamber positioned between a low pressure fuel supply passage and a nozzle supply bore, and having a nozzle in fluid communication with said nozzle supply bore, a portion of said low pressure fuel supply passage being a low pressure fuel supply chamber in direct fluid communication with said fuel pressurization chamber via a bleed hole;

a hydraulically actuated needle check with one end positioned in said nozzle supply bore and being movable between a closed position that closes said nozzle and an open position that opens said nozzle:

means, within said injector body, for biasing said needle check toward said closed position;

a bleed pin extending into said fluid supply chamber adjacent said bleed hole, said bleed pin being movable between a first position in which said bleed hole is open and a second position in which a portion of said bleed pin closes said bleed hole;

a supply valve positioned in said low pressure fuel supply passage between said low pressure fuel supply chamber and said fuel pressurization chamber, said supply valve preventing flow of fuel from said fuel pressurization chamber to said low pressure fuel supply chamber through said low pressure fuel supply passage;

means, within said injector body, for moving said bleed pin from said second position toward said first position to open said bleed hole when said needle check moves from said open position toward said closed position;

wherein said needle check moves from said closed position toward said open position when fuel pressure within said nozzle supply bore is above a threshold pressure; and means, within said injector body, for delaying the movement of said bleed pin when moving toward said second position.

8. The fuel injector of claim 7, wherein said means for delaying includes a spring that compresses when said needle check is moving toward said open position.

9. The fuel injector of claim 8, wherein said spring is uncompressed when said needle check is in said closed position.

10. The fuel injector of claim 9, wherein said spring is positioned between said needle check and said bleed pin.

11. The fuel injector of claim 9, wherein said spring is positioned against said one end of said bleed pin.

* * * * *